US006502967B2

(12) United States Patent
Mullen

(10) Patent No.: US 6,502,967 B2
(45) Date of Patent: Jan. 7, 2003

(54) GIMBLE RING LIGHTING FIXTURE SUPPORT

(76) Inventor: Nate Mullen, 1240 Simpson Way, Escondido, CA (US) 92029

( * ) Notice: Subject to any disclaimer, the term of this patent is extended or adjusted under 35 U.S.C. 154(b) by 0 days.

(21) Appl. No.: 09/737,420

(22) Filed: Dec. 14, 2000

(65) Prior Publication Data

US 2002/0075690 A1 Jun. 20, 2002

(51) Int. Cl.[7] ..... F21V 19/02; F21V 21/26

(52) U.S. Cl. ..... 362/427; 362/285; 362/288; 362/419; 362/430

(58) Field of Search ..... 362/153.1, 285, 362/287, 288, 368, 370–372, 417–419, 427–430, 432

(56) References Cited

U.S. PATENT DOCUMENTS 2,894,693 A * 7/1959 Howarth ..... 362/371
4,164,009 A * 8/1979 Maguire, Jr. et al. ..... 362/371
4,849,864 A * 7/1989 Forrest ..... 362/427
4,931,917 A * 6/1990 Scherft et al. ..... 362/371
5,205,643 A * 4/1993 Lin ..... 362/371
5,303,134 A * 4/1994 Cunado ..... 362/372

* cited by examiner

*Primary Examiner*—Alan Cariaso
(74) *Attorney, Agent, or Firm*—Joseph A. Yanny; Michael A. DiNardo

(57) ABSTRACT

This invention relates to a lighting fixture support with a pivoting mounting bracket. More specifically, this invention is aimed at providing a well-type lighting fixture for use in outdoor, below ground lighting settings which is easily positioned at various angles with respect to the ground. The inventive mounting bracket comprises a first bracket which is connected to a second bracket at a pivot point. One or more dimples on either of the brackets are operatively connected to one or more sets of ratchet teeth on the other bracket. The dimples and sets of ratchet teeth cooperate to secure the first bracket into discrete positions about the pivot point with respect to the second bracket.

11 Claims, 2 Drawing Sheets

GIMBLE RING LIGHTING FIXTURE SUPPORT

CROSS-REFERENCE TO RELATED APPLICATION Not Applicable.

STATEMENT RE: FEDERALLY SPONSORED RESEARCH AND DEVELOPMENT

Not Applicable.

BACKGROUND OF THE INVENTION

1. Field of the Invention

This invention relates to a lighting fixture support with a pivoting mounting bracket. More specifically, this invention is aimed at providing a well-type lighting fixture for use in outdoor, below ground lighting settings which is easily positioned at various angles with respect to the ground.

2. Description of the Related Art

The prior art discloses several types of well lights. Well lights generally consist of a hollow, cylindrical tube which is buried in the ground and contains a light fixture secured therein. In such lights, the fixture is generally capable of being positioned at various heights with respect to ground level. Variations on the securing means include guides and screws, mechanisms to hang the fixture from the top edge of the tube, or flexible members which exert pressure against the sides of the tube and retain the fixture through force of friction.

Such light fixtures are also generally capable of being angled at various degrees in relation to the ground surface. The primary mechanism used by artisans for angling such light fixtures include pivot points with securing screws.

Drawbacks of the prior art mechanisms include difficulty in positioning and retaining light fixtures in the tube. In addition, the mechanism for angling prior art light fixtures is difficult to use both at installation and later if the angle is to be changed. This is because such securing screws are generally threaded in opposite directions such that when one screw is tightened or loosened and the angle changed, the other screw loosens or tightens by the action of the movement. Another drawback of the prior art mechanism is that it has an inherent difficulty in use in that the light fixture must be removed from the tube in order to change the angle and properly tighten the securing screws.

BRIEF SUMMARY OF THE INVENTION

The main object of this invention is to provide a well-type lighting fixture support which is easy to install.

It is a another object of this invention is to provide a well-type lighting fixture support on which the settings are easy to adjust.

It is a further object of this invention is to provide a well-type lighting fixture support on which the angle may be adjusted without removal of the entire fixture.

DETAILED DESCRIPTION OF THE INVENTION

The instant invention is directed to a lighting fixture with a pivoting mounting bracket. Primarily, this invention is aimed at providing a well-type lighting fixture for use in outdoor, below ground lighting settings which is easily positioned at various angles with respect to the ground. The principles of this invention are equally applicable to use in other areas of lighting, such as indoor, above ground, or non-well-type lighting fixtures.

The novel designs of the present invention address the shortcomings of prior art lighting systems, namely, by providing: (i) a light fixture which is easily installed and removed; (ii) a light fixture capable of being angled at different degrees which is easily adjusted; and (iii) a lighting fixture which incorporates the above benefits in a cost effective product.

Figure 1:
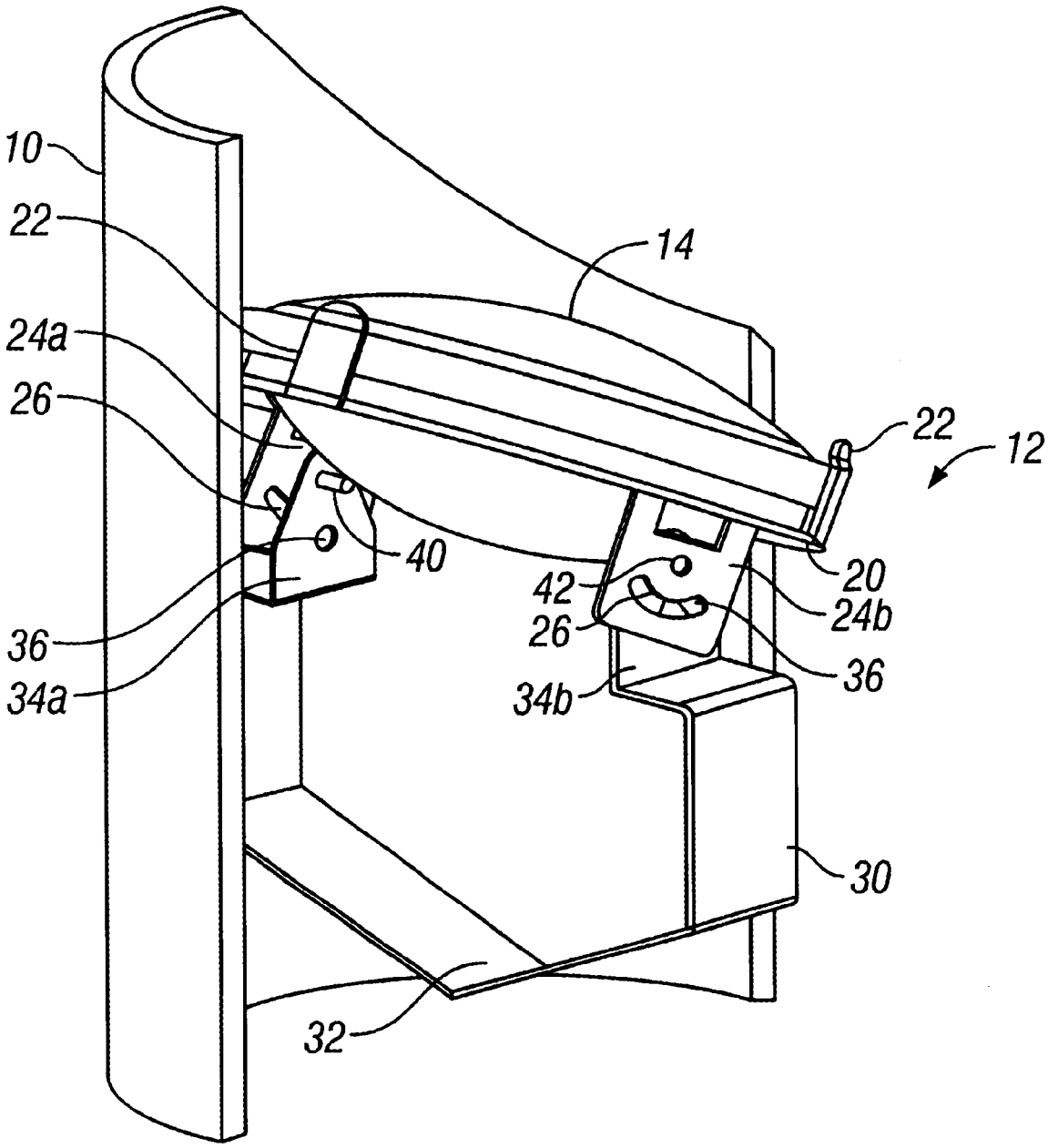
FIG. 1 shows a perspective view of the inventive light fixture in a cut-away cylindrical tube.
Figure 3:
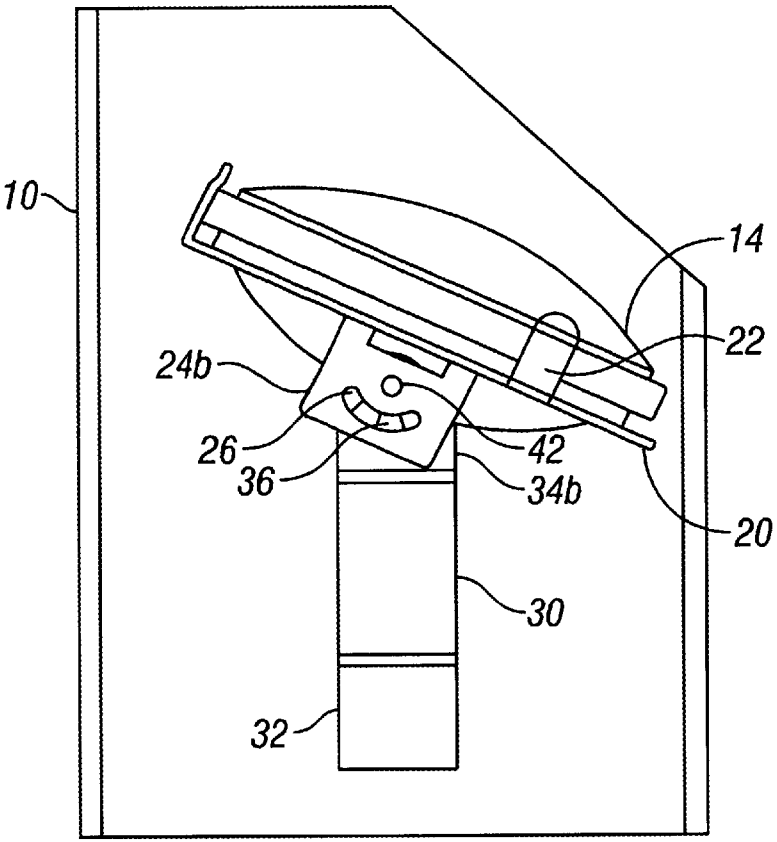
FIG. 3 shows a side view of the inventive light fixture in a cut-away cylindrical tube.
Figure 2:
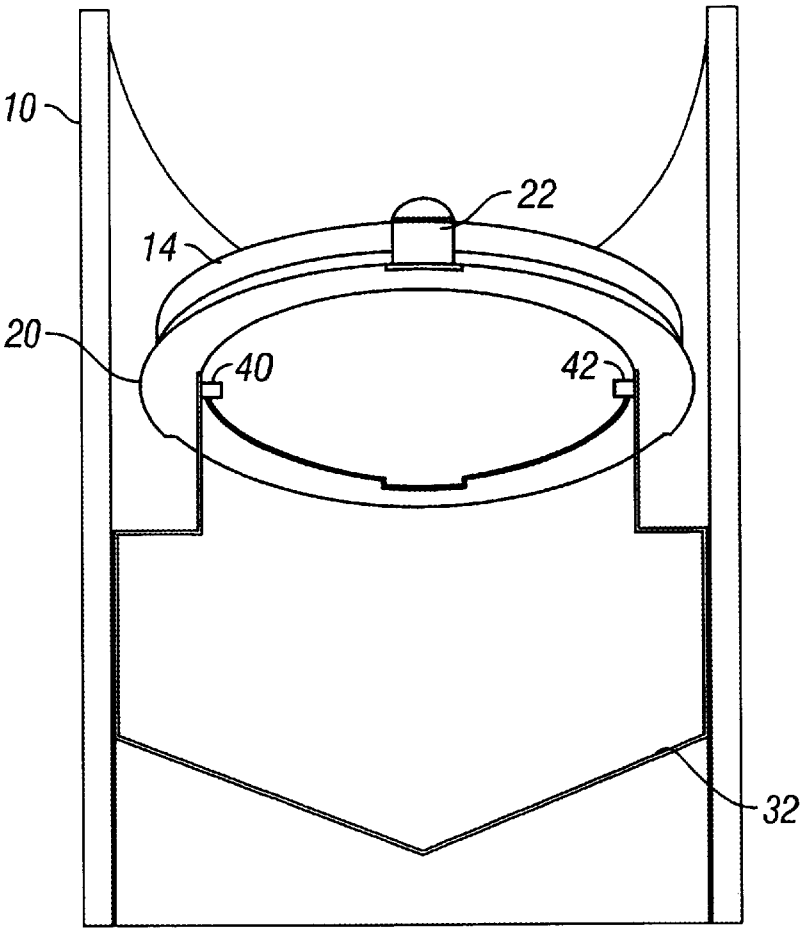
FIG. 2 shows a back view of the inventive light fixture in a cut-away cylindrical tube.

FIGS. 1, 2 and 3 show different views of the inventive light fixture support (12) in a cutaway cylindrical tube (10). The cylindrical tube (10) is designed to function as a well in the ground for receiving the light fixture support (12). Such well lights are well known in the art and a skilled artisan will be readily familiar with the function this type of light fixture. The cylindrical tube (10) may be constructed of any material commonly used in the art, i.e., plastic, metal, ceramic, etc. The preferred embodiment of the present invention uses black ABS plumbing pipe in the manufacture of the cylindrical tube (10).

The light fixture support (12) consists of a first bracket (20) and a second bracket (30). In the preferred embodiment, the first bracket (20) is generally circular in shape and is designed to receive and retain a PAR-36 light bulb (14). In alternate embodiments of the inventive light fixture support (12), the first bracket (20) may take different shapes to receive and retain different light bulbs (14).

The first bracket (20) has a bulb securing means on the top side. This bulb securing means is designed to retain a light bulb (14), in the preferred embodiment, a PAR-36 light bulb. This bulb securing means may be in any form with which a skilled artisan is familiar, i.e., male/female treaded connection, bracket arms, retaining clips, etc.

In the preferred embodiment of the present invention, the bulb securing means consists of two or more bracket arms (22) to retain the light bulb (14). The bracket arms (22) rise up over the edge of the light bulb (14) and a lip on the end of the bracket arm (22) reaches over the edge of the light bulb (14) to retains it in the first bracket (20). Two bracket arms (22) will function to retain the light bulb (14), however, the preferred embodiment includes three bracket arms (22) to more securely retain the light bulb (14).

The first bracket (20) has first and second pivot arms (24*a* and 24*b*) on the bottom side. Alternate embodiments may use one pivot arm or more than two pivot arms. These alternate embodiments may take the form of a bar across the underside of the first bracket (20) which has one or more pivot arms thereupon.

The pivot arms (24*a* and 24*b*) are attached in such a way so as not to interfere with the mounting of the light bulb (14) in the first bracket (20). The pivot arms (24*a* and 24*b*) may be mounted anywhere across the bottom side the first bracket (20), from the inner portion as shown in the drawings to the outer portion(not shown). Mounting the pivot arms (24*a* and 24*b*) on the outside edge of the first bracket (20) further removes them from interfering with the mounting of the light bulb (14).

At least one of the pivot arms (24*a* or 24*b*) has a set of ratcheting teeth (26). This results in one or more sets of ratcheting teeth (26). In the preferred embodiment, each of the pivot arms (24*a* and 24*b*) has a set of ratcheting teeth (26). The more pivot arms (24*a* and 24*b*) which have sets of ratcheting teeth (26), the tighter and more secure the ratcheting mechanism of the invention will operate. This will be discussed below more fully.

The second bracket (30) has a retention bar (32) and first and second stationary arms (34*a* and 34*b*). The retention bar (32) is a flexible member which is compressible and expands on its own back to its original dimensions. The flexible nature of the retention bar (32) provides the pressure and friction force which retains the light fixture support (12) in a set position in the cylindrical tube (10). The retention bar (32) exerts force against the inner walls of the cylindrical tube (10). This force is such to create a friction force which holds the light fixture support (12) in a set position.

The first and second stationary arms (34*a* and 34*b*) are arranged in close proximity to the first and second pivot arms (24*a* and 24*b*) of the first bracket (20). In the preferred embodiment, the first and second stationary arms (34*a* and 34*b*) and the first and second pivot arms (24*a* and 24*b*) are directly adjacent to each other.

The first stationary arm (34*a*) and the first pivot arm (24*a*) are connected to each other by a first pivot securing means (40). Similarly, the second stationary arm (34*b*) and the second pivot arm (24*b*) are connected to each other by a second pivot securing means (42). The first and second pivot securing means (40 and 42) may take the form of any securing means known in the art, i.e., nut and bolt, cotter and pin, etc. In the preferred embodiment, the first and second pivot securing means (40 and 42) consist of a threaded stud with a washer and locking nut. The first and second pivot securing means (40 and 42) must allow for rotation of the first and second pivot arms (24*a* and 24*b*) in relation to the first and second stationary arms (34*a* and 34*b*). The first and second pivot securing means (40 and 42) must be aligned and have the same axis of rotation to allow the first bracket (20) to move in relation to the second bracket (30).

At least one of the stationary arms (34*a* and 34*b*) has a dimple (36). This may result in one or more dimples (36). In the preferred embodiment, each of the stationary arms (34*a* and 34*b*) has a dimple (36). The dimple (36) is in close proximity to the set of ratcheting teeth (26). When the first stationary arm (34*a*) and the first pivot arm (24*a*), or the second stationary arm (34*b*) and the second pivot arm (24*b*), are connected to each other by the pivot securing means (40 or 42), the dimple (36) and the set of ratcheting teeth (26) are in physical contact throughout the range of rotation of the first bracket (20) in relation to the second bracket (30).

The dimples (36) and sets of ratcheting teeth (26) are operatively connected to each other. At least a portion of the dimples (36) extend between the ratcheting teeth (26). The action of the dimples (36) extending between the ratcheting teeth (36) results in the pivot arms (24*a* and 24*b*) being securable in multiple discrete positions in relation to the stationary arms (34*a* and 34*b*), which in turn causes the first bracket (20) to be securable in multiple discrete positions in relation to the second bracket (30). The first bracket (20) and the second bracket (30) may be secured in multiple discrete positions depending upon the relative position of the dimples (36) with respect to the sets of ratcheting teeth (26).

The preferred embodiment of the invention has a dimple (36) on each stationary arm (34*a* and 34*b*). In the preferred embodiment, each dimple (36) is operatively connected to a set of ratchet teeth (26), one on each pivot arm (24*a* and 24*b*). The inventive light fixture support (12) will operate with fewer or more dimples (36) and sets of ratcheting teeth (26). However, the inventive light fixture support (12) must have at least one dimple (36) and one set of ratchet teeth (26) which are operatively connected to each other. In alternate embodiments, the dimples (36) may be on the pivot arms (24*a* and 24*b*) and the ratcheting teeth (26) may be on the stationary arms (34*a* and 34*b*).

All of the components of this apparatus may be manufactured from any materials commonly used in the construction of light fixtures. In the preferred embodiment of the invention, all of the components are manufactured from stainless steel. The use of stainless steel prevents rust and corrosion. In an alternate embodiment, the components of this invention can be manufactured from injection molded plastic.

The above described invention is capable of being used in nearly any lighting system, whether it is high, standard or low voltage, or whether it is indoor or outdoor lighting. A skilled artisan will recognize that this invention may be used on its own or in combination with any of the other prior art embodiments in various lighting systems.

The above-described preferred embodiments are intended to illustrate the principles of the invention, but not to limit its scope. Other embodiments and variations of these preferred embodiments will be apparent to those skilled in the art and may be made without departing from the spirit and scope of the invention as defined in the following claims.

I claim:

1. A light fixture support apparatus comprising:

a first bracket having a top side and a bottom side:

said top side having two or more bracket arms;

said bottom side having one or more pivot arms;

said one or more pivot arms having one or more sets of ratcheting teeth;

a second bracket comprising a retention bar connected to one or more stationary arms;

said one or more stationary arms having one or more dimples;

said one or more pivot arms of said first bracket connected to said one or more stationary arms of said second bracket by a pivot securing means;

said pivot securing means having an axis of rotation;

said one or more dimples on said one or more stationary arms operatively connected to said one or more sets of ratcheting teeth on said one or more pivot arms.

2. The light fixture support apparatus of claim 1 wherein said top side having three bracket arms.

3. The light fixture support apparatus of claim 1 wherein said bottom side of said first bracket has a first pivot arm and a second pivot arm.

4. The light fixture support apparatus of claim 3 wherein said first pivot arm and said second pivot arm each have a set of ratcheting teeth.

5. The light fixture support apparatus of claim 1 wherein said second bracket has a first stationary arm and a second stationary arm.

6. The light fixture support apparatus of claim 5 wherein said first stationary arm and said second stationary arm each have a dimple.

7. A light fixture support apparatus comprising:

a first bracket having a top side and a bottom side:

said top side having three or more bracket arms;

said bottom side having a first pivot arm and a second pivot arm;

said first pivot arm and said second pivot arm having one or more sets of ratcheting teeth;

a second bracket comprising a retention bar connected to a first stationary arm and a second stationary arm;

said first stationary arm and said second stationary arm having one or more dimples;

said first pivot arm of said first bracket connected to said first stationary arm of said second bracket by a first pivot securing means, said first pivot securing means having an axis of rotation;

said second pivot arm of said first bracket connected to said second stationary arm of said second bracket by a second pivot securing means, said second pivot securing means having an axis of rotation;

said first pivot securing means and said second pivot securing means having the same axis of rotation;

said one or more dimples on said first stationary arm and said second stationary arm operatively connected to said one or more sets of ratcheting teeth on said first pivot arms and said second pivot arm.

8. The light fixture support apparatus of claim 7 wherein said top side of said first bracket has three bracket arms.

9. The light fixture support apparatus of claim 7 wherein said first pivot arm and said second pivot arm each have a set of ratcheting teeth.

10. The light fixture support apparatus of claim 7 wherein said first stationary arm and said second stationary arm each have a dimple.

11. A light fixture support apparatus comprising:

a first bracket having a top side and a bottom side;

said top side having three bracket arms;

said bottom side having a first pivot arm and a second pivot arm;

said first pivot arm and said second pivot arm each having a set of ratcheting teeth;

a second bracket comprising a retention bar connected to a first stationary arm and a second stationary arm;

said first stationary arm and said second stationary arm each having a dimple;

said first pivot arm of said first bracket connected to said first stationary arm of said second bracket by a first pivot securing means, said first pivot securing means having an axis of rotation;

said second pivot arm of said first bracket connected to said second stationary arm of said second bracket by a second pivot securing means, said second pivot securing means having an axis of rotation;

said first pivot securing means and said second pivot securing means having the same axis of rotation;

said dimple on said first stationary arm operatively connected to said set of ratcheting teeth on said first pivot arm; and said dimple on said second stationary arm operatively connected to said set of ratcheting teeth on said second pivot arm.

* * * * *